US009948037B2

(12) United States Patent
Ashby

(10) Patent No.: US 9,948,037 B2
(45) Date of Patent: Apr. 17, 2018

(54) ADAPTER WITH AN ELECTRONIC FILTERING SYSTEM

(71) Applicant: ICON Health & Fitness, Inc., Logan, UT (US)

(72) Inventor: Darren C. Ashby, Richmond, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 245 days.

(21) Appl. No.: 14/744,443

(22) Filed: Jun. 19, 2015

(65) Prior Publication Data

US 2015/0372416 A1 Dec. 24, 2015

Related U.S. Application Data

(60) Provisional application No. 62/015,234, filed on Jun. 20, 2014.

(51) Int. Cl.

| | |
|---|---|
| ***H01R 13/53*** | (2006.01) |
| ***H01R 13/713*** | (2006.01) |
| ***H01R 13/719*** | (2011.01) |
| ***H01R 27/02*** | (2006.01) |
| *H01R 24/68* | (2011.01) |
| *H01R 31/02* | (2006.01) |

(52) U.S. Cl.

CPC ..... *H01R 13/719* (2013.01); *H01R 24/68* (2013.01); *H01R 27/02* (2013.01); *H01R 31/02* (2013.01)

(58) Field of Classification Search

CPC ..... H01R 13/719; H01R 24/68; H01R 27/02; H01R 31/02

USPC ..... 361/111

See application file for complete search history.

(56) References Cited

U.S. PATENT DOCUMENTS

| | | | | |
|---|---|---|---|---|
| 4,259,705 | A * | 3/1981 | Stifter | H01R 13/6666 333/12 |
| 5,452,223 | A | 9/1995 | Zuercher et al. | |
| 5,561,605 | A | 10/1996 | Zuercher et al. | |
| 6,937,455 | B2 | 8/2005 | Krichtafovitch et al. | |
| 7,068,480 | B2 | 6/2006 | Wong et al. | |
| 7,136,265 | B2 | 11/2006 | Wong et al. | |
| 7,460,346 | B2 | 12/2008 | Deshpande et al. | |
| 9,350,315 | B1 * | 5/2016 | Gonzalez Moreno | H03H 7/24 |

* cited by examiner

*Primary Examiner* — Thienvu Tran
*Assistant Examiner* — Kevin J Comber
(74) *Attorney, Agent, or Firm* — Holland & Hart PC

(57) ABSTRACT

An adapter includes a first plug with at least one electrically conductive prong, a first socket shaped to make an electrical connection when a second plug is secured to the first socket, an electrically conductive pathway that connects the first plug with the first socket, and a filtering mechanism disposed along the electrically conductive pathway that modifies an electrical waveform signature sufficient that it avoids nuisance tripping by an arc fault detector when the electrically conductive pathway provides electrical power to an electrical load.

20 Claims, 7 Drawing Sheets

ADAPTER WITH AN ELECTRONIC FILTERING SYSTEM

RELATED APPLICATIONS

This application claims priority to provisional Patent Application No. 62/015,234 titled "An Adapter with an Electronic Filtering Mechanism" filed Jun. 20, 2014. This application is herein incorporated by reference for all that it discloses.

BACKGROUND

A circuit breaker can protect against fires by breaking an electrical circuit in a building's power line in response to detecting a dangerous situation, such as an overload condition or a short circuit condition. Often, a homeowner or a technician can manually reset a switch in the circuit breaker when the dangerous situation has passed.

Another mechanism associated with a circuit breaker is an arc fault detector, which uses electronics to analyze the characteristics of waveforms exhibited in power signals when a device is plugged into a power line of a building. The arc fault detector determines whether electrical arcing is occurring in a device plugged into the building's power line. The arc fault detectors conclude, based on the power signal's characteristics, whether arcing is occurring. Generally, if the signal's waveform characteristics fall within a predetermined set of parameters, the arc fault detector determines that a dangerous condition exists and causes a circuit breaker to shut off electrical power to the power line, and thereby to the plugged device.

One type of arc fault detector is disclosed in U.S. Pat. No. 7,136,265 issued to Kon B. Wong. In this reference, a method and system is disclosed for determining whether arcing is present in an electrical circuit. The method includes sensing a change in an alternating current in the circuit and developing a corresponding input signal, analyzing the input signal to determine the presence of broadband noise in a predetermined range of frequencies, producing a corresponding output signal, and processing the input signal and the output signal in a predetermined fashion to determine whether an arcing fault is present in the circuit. The processing includes determining a type of load connected to the electrical circuit, based at least in part upon the input signal and the output signal, and monitoring high frequency noise in a 20 KHz band for each ⅛ cycle of the alternating current. Another type of arc fault detector is disclosed in U.S. Pat. No. 7,460,346 to Vijay V. Deshpande. Both of these references are incorporated by reference in their entirety.

SUMMARY

In a preferred embodiment of the invention, an adapter includes a first plug with at least one electrically conductive prong, a first socket shaped to make an electrical connection when a second plug is secured to the first socket, an electrically conductive pathway that connects the first plug with the first socket, and a filtering mechanism disposed along the electrically conductive pathway that modifies an electrical waveform signature sufficient to avoid nuisance tripping by an arc fault detector when the electrically conductive pathway provides electrical power to an electrical load.

In one aspect of the invention, which may be combined with any other aspect of the invention, the filtering mechanism includes at least one inductive filter.

In one aspect of the invention, which may be combined with any other aspect of the invention, the filtering mechanism includes at least one capacitive filter.

In one aspect of the invention, which may be combined with any other aspect of the invention, the filtering mechanism includes a first inductive filter, a first capacitive filter, a second inductive filter, and a second capacitive filter.

In one aspect of the invention, which may be combined with any other aspect of the invention, the filtering mechanism modifies the electrical waveform signature by reducing an amplitude of the waveform.

In one aspect of the invention, which may be combined with any other aspect of the invention, the filtering mechanism modifies the electrical waveform signature by reducing the amplitude within a frequency range of 150.0 kilohertz to 30.0 megahertz.

In one aspect of the invention, which may be combined with any other aspect of the invention, the frequency range is 1.0 megahertz to 6.0 megahertz.

In one aspect of the invention, which may be combined with any other aspect of the invention, the filtering mechanism modifies the electrical waveform signature by reducing the amplitude to below 60.0 decibels within the frequency range.

In one aspect of the invention, which may be combined with any other aspect of the invention, the filtering mechanism modifies the electrical waveform signature by reducing the amplitude to below 50.0 decibels within the frequency range.

In one aspect of the invention, which may be combined with any other aspect of the invention, the adapter may further include a second socket in electrical communication with the first plug through the electrically conductive pathway.

In one aspect of the invention, which may be combined with any other aspect of the invention, the second socket is positioned in an orthogonal orientation to the first socket.

In one aspect of the invention, which may be combined with any other aspect of the invention, the electrically conductive pathway includes a surge protection mechanism.

In one aspect of the invention, which may be combined with any other aspect of the invention, an adapter includes a first plug with at least one electrically conductive prong.

In one aspect of the invention, which may be combined with any other aspect of the invention, the adapter further includes a first socket shaped to make an electrical connection when a second plug is secured to the first socket.

In one aspect of the invention, which may be combined with any other aspect of the invention, the adapter further includes an electrically conductive pathway that connects the first plug with the first socket.

In one aspect of the invention, which may be combined with any other aspect of the invention, the adapter further includes at least one filtering mechanism disposed along the electrically conductive pathway that modifies an electrical waveform signature sufficient to avoid nuisance tripping by an arc fault detector when the electrically conductive pathway provides electrical power to an electrical load.

In one aspect of the invention, which may be combined with any other aspect of the invention, the filtering mechanism modifies the electrical waveform signature by reducing an amplitude of the waveform within a frequency range within 150.0 kilohertz to 30.0 megahertz to below 60.0 decibels within the frequency range.

In one aspect of the invention, which may be combined with any other aspect of the invention, the filtering mechanism comprises at least one inductive filter.

In one aspect of the invention, which may be combined with any other aspect of the invention, the filtering mechanism comprises at least one capacitive filter.

In one aspect of the invention, which may be combined with any other aspect of the invention, the filtering mechanism modifies the electrical waveform signature by reducing the amplitude to below 50.0 decibels within the frequency range.

In one aspect of the invention, which may be combined with any other aspect of the invention, the adapter further includes a second socket in electrical communication with the first plug through the electrically conductive pathway.

In one aspect of the invention, which may be combined with any other aspect of the invention, the second socket is positioned in an orthogonal orientation to the first socket.

In one aspect of the invention, which may be combined with any other aspect of the invention, the electrically conductive pathway includes a surge protection mechanism.

In one aspect of the invention, which may be combined with any other aspect of the invention, an adapter includes a first plug with at least one electrically conductive prong.

In one aspect of the invention, which may be combined with any other aspect of the invention, the adapter further includes a first socket shaped to make an electrical connection when a second plug is secured to the first socket.

In one aspect of the invention, which may be combined with any other aspect of the invention, the adapter further includes an electrically conductive pathway that connects the first plug with the first socket.

In one aspect of the invention, which may be combined with any other aspect of the invention, the adapter further includes at least one filtering mechanism disposed along the electrically conductive pathway that modifies an electrical waveform signature sufficient to avoid nuisance tripping by an arc fault detector when the electrically conductive pathway provides electrical power to an electrical load.

In one aspect of the invention, which may be combined with any other aspect of the invention, the filtering mechanism comprises a first inductive filter, a first capacitive filter, a second inductive filter, and a second capacitive filter.

In one aspect of the invention, which may be combined with any other aspect of the invention, the filtering mechanism modifies the electrical waveform signature by reducing an amplitude of the waveform within a frequency range within 150.0 kilohertz to 30.0 megahertz to below 50.0 decibels within the frequency range.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

In a home setting, an appliance can be plugged into an adapter and the adapter can be plugged into a socket installed in a wall of the home. The electrical power source of the home can provide power to the appliance through the adapter. Often, an arc fault detector is in communication with the power line providing power to the adapter. The arc fault detector can analyze the characteristics of a power signal to detect characteristics that indicate accidental arcing in the device receiving power.

However, some devices intentionally create arcs as part of their normal operation and are not prone to creating a fire. An example of such an operational arcing device may include devices with brush motors. Such operational arcing devices are often designed to prevent fires despite their operational arcing and are not generally dangerous. However, when such operational arcing devices are plugged into the power system of a home, an arc fault detector may detect the operational arcing based on the power signal's characteristics. When such characteristics are detected, some arc fault detectors cause a circuit breaker to trip, disconnecting the operational arcing device from the power source. As a result, the operational arcing device is cut off from power despite being safe to operate.

The principles described herein provide an adapter that can be used with such safe operational arcing devices without nuisance tripping. The adapter can remove features of the power signal's characteristics that reveal operational arcing in the device. For example, a filtering mechanism of the adapter may reduce the amplitude of the power signal's characteristics from the operational arcing devices. If the arc fault detection mechanism looks for amplitude parameters in the waveform characteristics of the power signal, such a filtering mechanism can change the amplitude of the electrical signal's waveform and prevent nuisance tripping. In this manner, nuisance tripping is avoided and the operational arcing device can continue to operate under its normal conditions.

Figure 1:
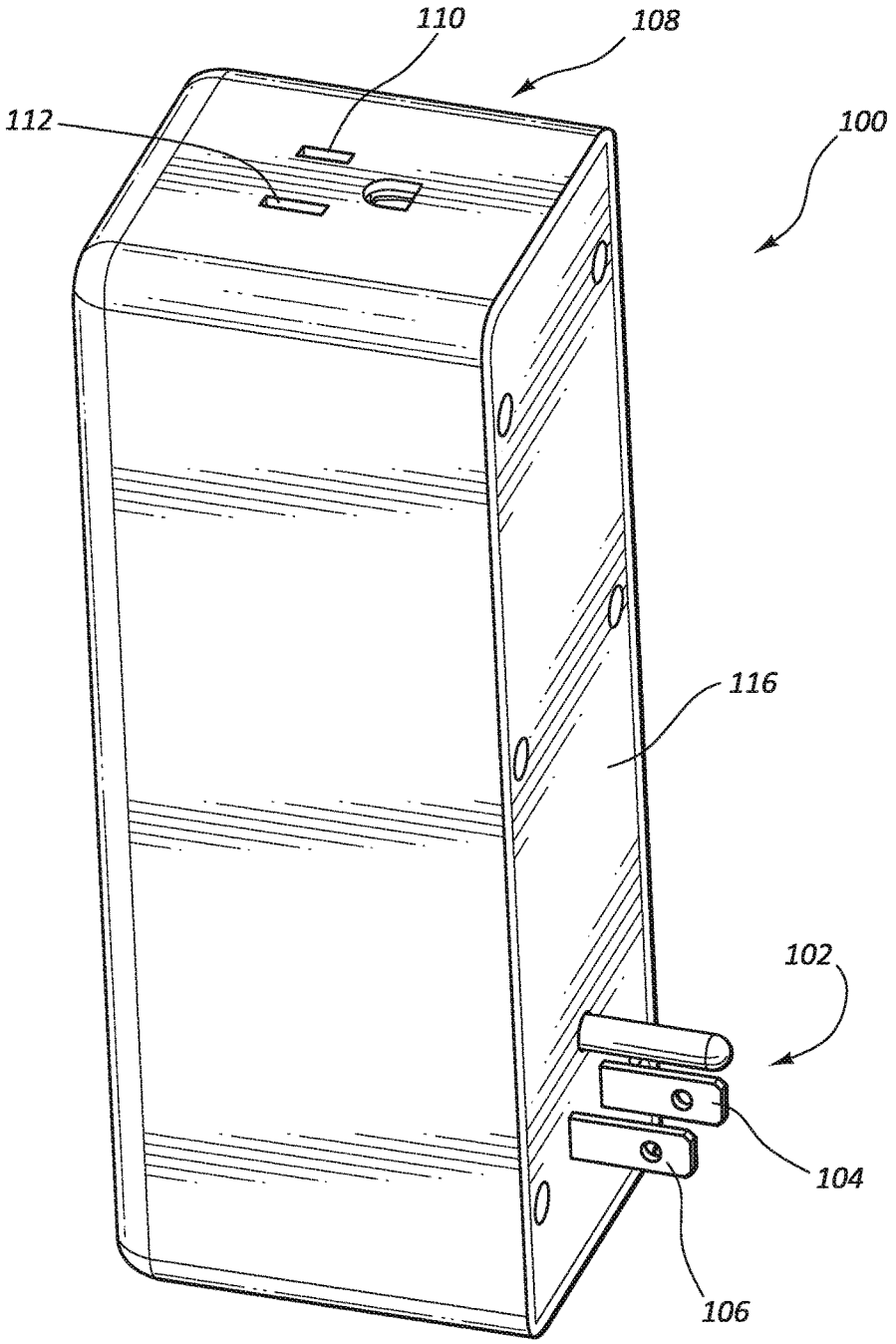
FIG. 1 illustrates a perspective view of an example of an adapter in accordance with the present disclosure.
Figure 2:
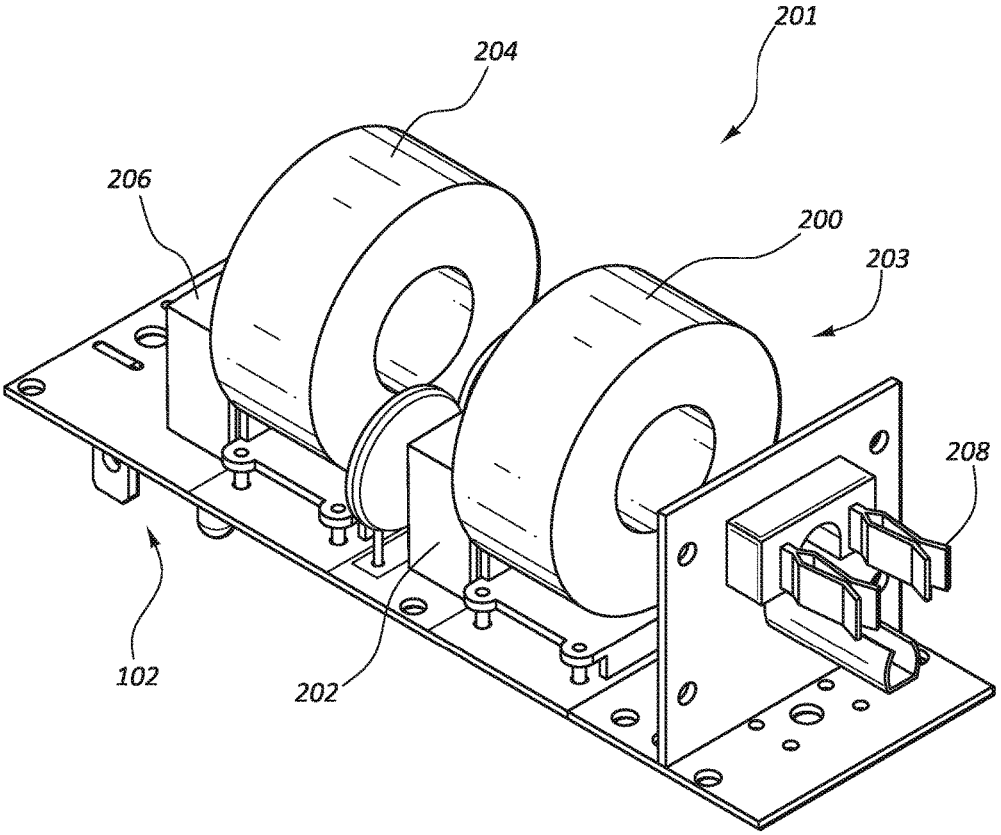
FIG. 2 illustrates a perspective view of an example of a filtering mechanism in accordance with the present disclosure.

Particularly, with reference to the figures, FIGS. 1-2 depict an example of an adapter 100 in accordance with the present disclosure. The adapter 100 includes a plug 102 with a first prong 104 and a second prong 106. Further, the adapter 100 includes an adapter socket 108 that includes a first receptacle 110 and a second receptacle 112 for receiving plugs from other operational arcing devices such as appliances, blenders, treadmills, vacuums, other devices, and so forth. The adapter 100 also includes an electrically conductive pathway 201 internal to a housing 116 of the adapter 100. The electrically conductive pathway 201 includes at least one filtering mechanism 203.

The plug 102 can be inserted into a building electrical socket that is in electrical communication with a power source. In some examples, the power source is an alternating current (AC) power source provided to the building from the power grid. Additionally, an operational arcing device can be plugged into the adapter socket 108. When the operational arcing device is plugged into the adapter 100, and an operational arcing device is plugged into the adapter 100, the operational arcing device can receive electrical power from the building's power source.

In some examples, the building's electrical wiring may include various types of protection mechanisms. For example, one such protection mechanism may include a circuit breaker that can detect a surge in electrical power. In a situation where such a circuit breaker detects such a surge, the circuit breaker may break the electrical circuit, thereby preventing the flow of electrical power to the operational arcing device. Another type of protection mechanism that may be incorporated into the building's wiring includes an arc fault detector that may analyze the characteristics of the waveforms of the electrical signal that result from the use of the operational arcing device plugged into the adapter 100. The arc fault detector may identify waveform patterns (signatures) that often result in response to an accidental arcing occurring somewhere in the power circuit that provides power to the operational arcing device. To prevent the future accidental arcing, the arc fault detector may cause the circuit breaker to break the electrical power circuit to stop power from reaching the operational arcing device.

Many types of safe and commonly used devices use brush motors, which often generate operational arcing during their normal operations. Such operational arcing can be detected by the arc fault detector, which then discontinues power, thereby preventing these safe, operational arcing devices from receiving power. These nuisance trips can be avoided with the filtering mechanism 203 incorporated into the adapter 100. The filtering mechanism 203 has the ability to change the waveform characteristics on the power line such that the waveform's characteristics are outside of the parameter ranges searched by the arc fault detector.

The arcing signatures may be programmed into the arc fault detector to have an amplitude over 70.0 decibels in a frequency range between 150.0 kilohertz and 30.0 megahertz. In some examples, the arcing signature may include a narrower frequency range. For example, the frequency range may be between 1.0 and 6.0 megahertz, 2.0 to 3.0 megahertz, another range, or combinations thereof. Further, the amplitude range may be from 50.0 decibels to a 110.0 decibels. However, such an amplitude range may be narrower, such as between 70.0 and 90.0 decibels, another range, or combinations thereof.

The filtering mechanism 203 may appropriately modify the waveform characteristics in any appropriate manner so that the waveform's characteristics fall outside of the parameters that the arc fault detector associates with accidental arcing. For example, the filtering mechanism 203 may modify the frequency characteristics of the waveform, the amplitude characteristics of the waveform, other characteristics of the waveform, or combinations thereof. Further, the filtering mechanism 203 may alter the amplitude within just a specific frequency range or alter the frequency within just a specific amplitude range.

Any appropriate type of filtering mechanism 203 may be used in accordance with the principles described herein. For example, the filtering mechanism 203 may be a passive filtering mechanism 203 that causes the modifications to occur to the waveform passively. However, in other examples, the filtering mechanism 203 is an active filtering mechanism 203 where additional power is used by the filtering mechanism 203 to alter the waveform characteristics.

In some examples, the adapter's logic allows the filtering mechanism to switch into a filtering mechanism in appropriate circumstances. In such an example, the adapter 100 can include an analyzer to determine if the waveform's characteristics are exhibiting accidental arcing signatures or other types of indicators that suggest that the power line will shortly exhibit the arcing signatures. The filtering mechanism may automatically activate in response to detecting such indicators. In such circumstances, the adapter 100 can switch into a filtering mode before the arc fault detector identifies an arcing signature and shuts off power to the operational arcing device. In other examples, the adapter 100 includes a manual switching mechanism that allows the user to manually instruct the adapter to use the filtering mechanism or not. Thus, the user can choose when the waveform is to be altered. For example, if the user knows that the device to be plugged into the adapter 100 is a device that uses a brush motor or another type of operational arcing device, the user may manually switch the adapter 100 into a filtering mode to prevent nuisance tripping. In other circumstances, the user may select a non-filtering mode because the user knows that he or she is using an device that does not use operational arcing. In such examples, any appropriate type of input mechanism may be incorporated into the adapter 100 to allow the user to input into the adapter 100 which type of mode (filtering or non-filtering) the user desires. Such input mechanisms may include levers, buttons, touch screens, mobile devices in communication with the adapter, dials, other types of input mechanism, or combinations thereof.

In some examples, a high-pass filter is used to modify the waveform characteristics of the electrical signal. Such a high-pass filter may allow portions of the signal with frequencies above a threshold frequency to pass unaltered. However, for portions of the signal that have a frequency below the threshold frequency, the characteristics of the waveform are altered. For example, for those frequencies below a specific threshold value, the amplitude of the waveform may be reduced by the filtering mechanism.

In other examples, a low-pass filter may be used to modify the characteristics of the waveform. In such an example, portions of a signal that have a frequency below a frequency threshold may pass through the filtering mechanism unaltered, but those portions of the signal that have a frequency higher than the frequency threshold may be modified. In such an example, those portions of the signal that have frequencies higher than the frequency threshold may experience an amplitude reduction.

Further, in other examples, the adapter 100 uses a band-pass filter, which is a filter that passes frequencies within a certain frequency range and modifies the portions of the signal that are outside of that frequency range. For example, those portions of the signal that have frequencies outside of the frequency range may experience an amplitude reduction.

In yet another example, the adapter 100 may use a band-stop filter, where just those frequencies within a predetermined frequency range are modified. In such an example, the portions of the signal with a frequency within the frequency range may also be subjected to reduced amplitudes. In one embodiment, a band-stop filter may be implemented according to the principles described herein to attenuate or reduce the amplitudes of those portions of the signal that are within a 150.0 kilohertz to 30.0 megahertz range, within a 1.0 megahertz to 6.0 megahertz range, within a 2.0 megahertz to 3.0 megahertz range, within another range, or combinations thereof.

Often, signatures that make evident arcing for certain types of operational arcing devices can fall within a frequency range of 2.0 megahertz to 5.0 megahertz. Thus, for adapters 100 constructed for these types of operational arcing devices, the adapter 100 may include a filtering mechanism 203 that includes a band-stop filter for a frequency range of 2.0 to 5.0 megahertz. Thus, the filtering mechanism 203 may cause the amplitudes within this frequency range to drop to avoid detection. However, even in such examples, the arc fault detector may conclude that higher amplitudes within broader frequencies ranges indicate the occurrence of accidental arcing. Thus, in such examples, the filtering mechanism 203 may include a larger frequency range. In other examples, the filtering mechanism 203 may include a low pass filter that allows all frequencies below 2.0 megahertz (a likely low end of the range where arcing signatures may occur in this example) to pass without alteration and for those frequencies above 2.0 megahertz to be altered with a lower amplitude. Similarly, the filtering mechanism 203 may allow those frequencies above 5.0 megahertz (a likely high end of the range where arcing signatures may occur in this example) to pass unaltered while all the frequencies below are altered to have lower amplitudes.

While these examples have been described with reference to specific frequency ranges, specific frequency thresholds, and other specific filter characteristics, any appropriate type of frequency range and/or frequency threshold may be used in accordance with the principles described herein. For example, the frequency bands and/or frequency thresholds may be set to narrowly cover the frequency range where an arcing signatures is likely. In other examples, the frequency range and/or frequency thresholds may be set to cover a broader range of frequencies than just the most likely frequencies that exhibit arcing signatures.

In the example of FIG. 2, the filtering mechanism 203 includes a first inductive filter 200, a first capacitive filter 202, a second inductive filter 204, and a second capacitive filter 206. In the illustrated example, the first and second inductive filters 200, 204 include a coil of wire incorporated into the electrically conductive pathway 201 linking the adapter socket 108 to the plug 102. However, any appropriate type of inductor may be used in accordance with the principles described in the present disclosure. Also, in the illustrated example, the first and second capacitive filters 202, 206 may include parallel plates that are incorporated into the electrically conductive pathway 201. However, any appropriate type of capacitor may be used in accordance with the principles described in the present disclosure.

While this example has been described with two inductive filters and two capacitive filters, any arrangement of filters may be used. For example, just a single capacitive filter and a single inductive filter may be used in the adapter 100. In alternative examples, just an inductive filter may be used or just a capacitive filter may be used. In yet other examples, more than two inductive filters may be used or more than just two capacitive filters may be used. In other examples, the filtering mechanism 203 may include additional circuit elements that may contribute to filtering the waveform. For example, one or more resistors may be added to the electrically conductive pathway to alter the waveform's characteristics. In such an example, the resistor may be used in combination with just the capacitive filters, just the inductive filters, or combinations thereof. Such a resistor may be incorporated on the plug side of either the inductive filter or the capacitive filter. Similarly, the resistor may be incorporated on the adapter socket side of either the inductive filter or the capacitive filter.

The adapter socket 108 may include electrical contacts 208 to receive the prongs of a plug from the operational arcing device. The electrical contacts 208 may be made of any appropriate type of electrically conductive material. In some examples, the electrical contacts are platted with an electrically conductive material. Any appropriate type of operational arcing device may be plugged into the adapter socket 108. In some examples, the operational arcing device has a brush motor that causes arcing under normal operating conditions. A non-exhaustive list of operational arcing devices that may be plugged into the adapter socket 108 include treadmills, elliptical exercise machines, washing machines, dryers, vacuums, blenders, pressure washers, air conditioners, devices with variable motor speeds, other types of devices, or combinations thereof. Such operational arcing devices may incorporate brush motors, switches, or other mechanisms that cause operational arcing during normal operation of these devices.

Figure 3:
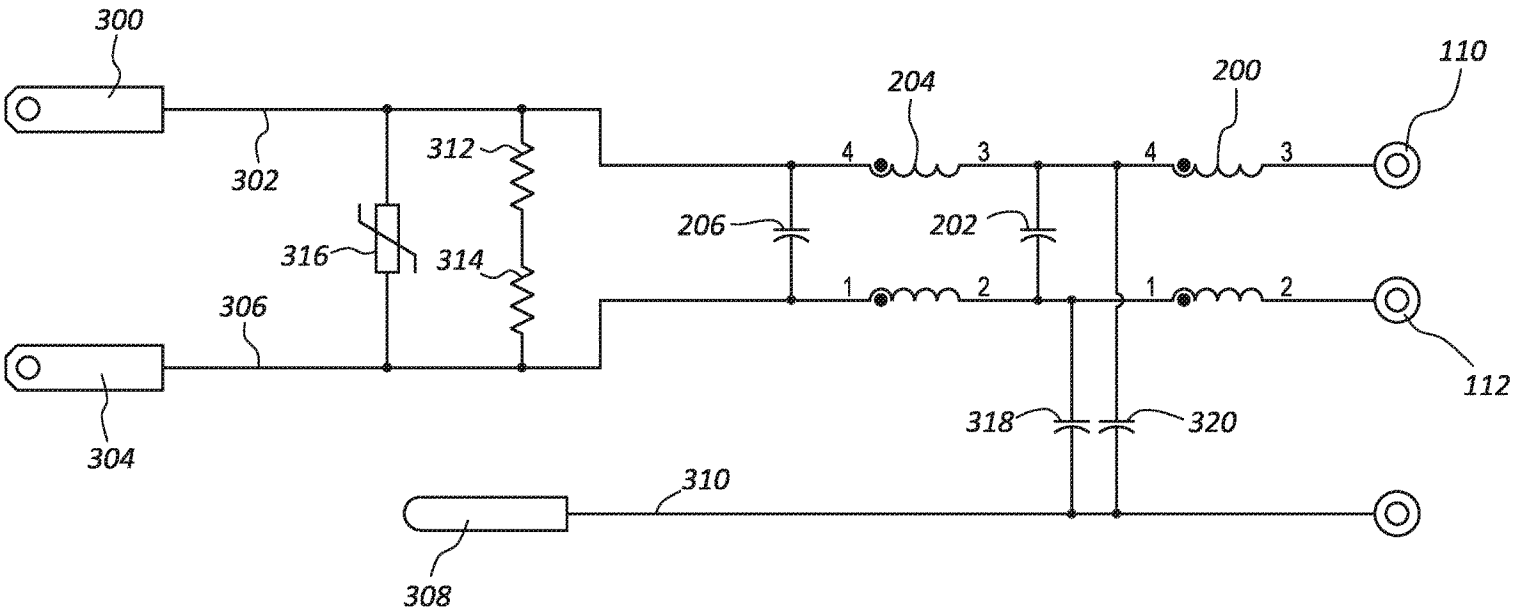
FIG. 3 illustrates a diagram of an example of circuitry of an adapter in accordance with the present disclosure.

FIG. 3 is a diagram of an example of circuitry of an adapter 100 in accordance with the present disclosure. In this example, the adapter 100 includes a plug 102 with an alternating current (AC) neutral prong 300 connected to an AC neutral line 302, an AC prong 304 connected to an AC line 306, and a ground prong 308 connected to a ground line 310. The AC neutral line 302 and the AC line 306 are electrically connected to the adapter socket 108. The first inductive filter 200, the first capacitive filter 202, the second inductive filter 204, and the second capacitive filter 206 are disposed along the electrically conductive pathway 201 connecting the plug 102 and the adapter socket 108. Further, a first resistor 312 and a second resistor 314 connected in series is also disposed along the electrically conductive pathway 201 and are in parallel with a varistor 316.

In some examples, the first and/or second inductive filter 200, 204 is a 4.0 micro-Henry inductor. However, any appropriate type of inductor may be used for the first and/or second inductive filters 200, 204.

In some examples, the first and/or second capacitive filter 202, 206 is a 1.0 micro-Farad capacitor with a continuous AC maximum rating for 275 volts. However, any appropriate type of capacitor may be used for the first and/or second capacitor 202, 206.

In some examples, the first and/or second resistor 312, 314 is a 1.0 mega-Ohm resistor. However, any appropriate type of resistor may be used for the first and/or second resistor 312, 314.

A surge protection mechanism may be incorporated into the adapter 100. In the example of FIG. 3, the surge protection mechanism includes a voltage dependent varistor 316 that is connected to the AC neutral line 302 and the AC line 306. The varistor 316 can change its level of resistance based on the amount voltage to which the varistor 316 is subjected. Generally, under normal operating conditions, where the varistor 316 is subjected to voltages within an expected range, the varistor's resistance is high. In such a high resistance state, the varistor 316 allows little, if any, electrical current to pass. Current still flows through the adapter 100 through the AC line 306 and AC neutral line 302, but bypasses the varistor 316. However, when exposed to higher than expected voltages, the varistor's resistance automatically lowers, which allows more current to flow through the varistor 316. The resistance of the varistor 316 with a lower resistance may create a more preferential electrical pathway to ground. As a result, current flow is diverted from the AC line 306 and AC neutral line 302 to ground through the low resistance varistor 316. Such rerouting prevents a current surge away from the operational arcing devices plugged into the adapter 100 thereby sparing the operational arcing device from the increased amount of current flow. For example, if a high voltage is applied to the varistor 316, the varistor 316 may exhibit a low resistance and thereby cause the electrical current to bypass the components of the adapter's circuitry and those devices plugged into the adapter 100. Such current spikes may be diverted to the ground line 310. On the other hand, the varistor 316 may exhibit a higher resistance in situations where the varistor is subjected to a lower voltage within the expected voltage range. In such expected voltage ranges, the varistor's high resistance prevents the varistor 316 from forming a short path to ground, which causes the electrical current to flow through the other components of the adapter 100 and to the operational arcing devices.

In one example, the varistor may be a metal oxide varistor. A metal-oxide varistor may exhibit the non-linear current-voltage characteristics as described above. Such varistors 316 can be used to protect the adapter 100 against excessive transient voltages, such as lighting strikes or other events that impose voltage spikes on adapter 100. By incorporating such metal oxide varistors into the adapter's circuit, the metal oxide varistor 316 can shunt the current created by the high voltage away from sensitive components.

In some examples, the metal-oxide varistor contains a ceramic material. Such a ceramic material may include zinc oxide, bismuth oxide, cobalt oxide, manganese oxide, other types of metal oxides, or combinations thereof. The ceramic material may be positioned between two electrodes. The molecular characteristics of the grains of the metal oxides form boundaries which cause the current to flow in only one direction. Thus, such a ceramic material forms multiple diode junctions throughout its volume. When a small or moderate voltage is applied across the electrodes, only a tiny current flows, caused by reverse leakage through the diode junctions. When a large voltage is applied, the diode junction breaks down due to thermionic emission and electron tunneling. The break down in the junction pairs results in a large current flow through the ceramic material.

While this example of a surge protection mechanism has been described with reference to a metal oxide varistor, any appropriate type of voltage-dependent resistance mechanism may be used in accordance with the principles described in the present disclosure for surge protection. For example, voltage suppression diodes, Zener diodes, other types of varistors, gas discharge tubes, transient voltage suppressors, avalanche diodes, other types of surge protection mechanisms, or combinations thereof may be used in accordance with the principles described in the present disclosure.

Additionally, a third capacitor 318 may electrically connect the AC line 306 to the ground line 310, and a fourth capacitor 320 may electrically connect the AC neutral line 302 to the ground line 310. In some examples, the third and fourth capacitors 318, 320 may be 10000.0 pico-Farad capacitors with a continuous maximum AC voltage limit of 250 volts.

While the illustrated example puts forth a single electrical circuit for an adapter 100 with a filtering mechanism, any appropriate type of circuitry may be used for an adapter that includes a filtering mechanism capable of modifying the electrical signal's waveform to avoid arc fault detection based nuisance tripping. For example, filtering elements, such as inductors, resistors, capacitors, and so forth, may be arranged in parallel, in series, in different spatial order with respect to other circuit components, or combinations thereof.

Figure 4:
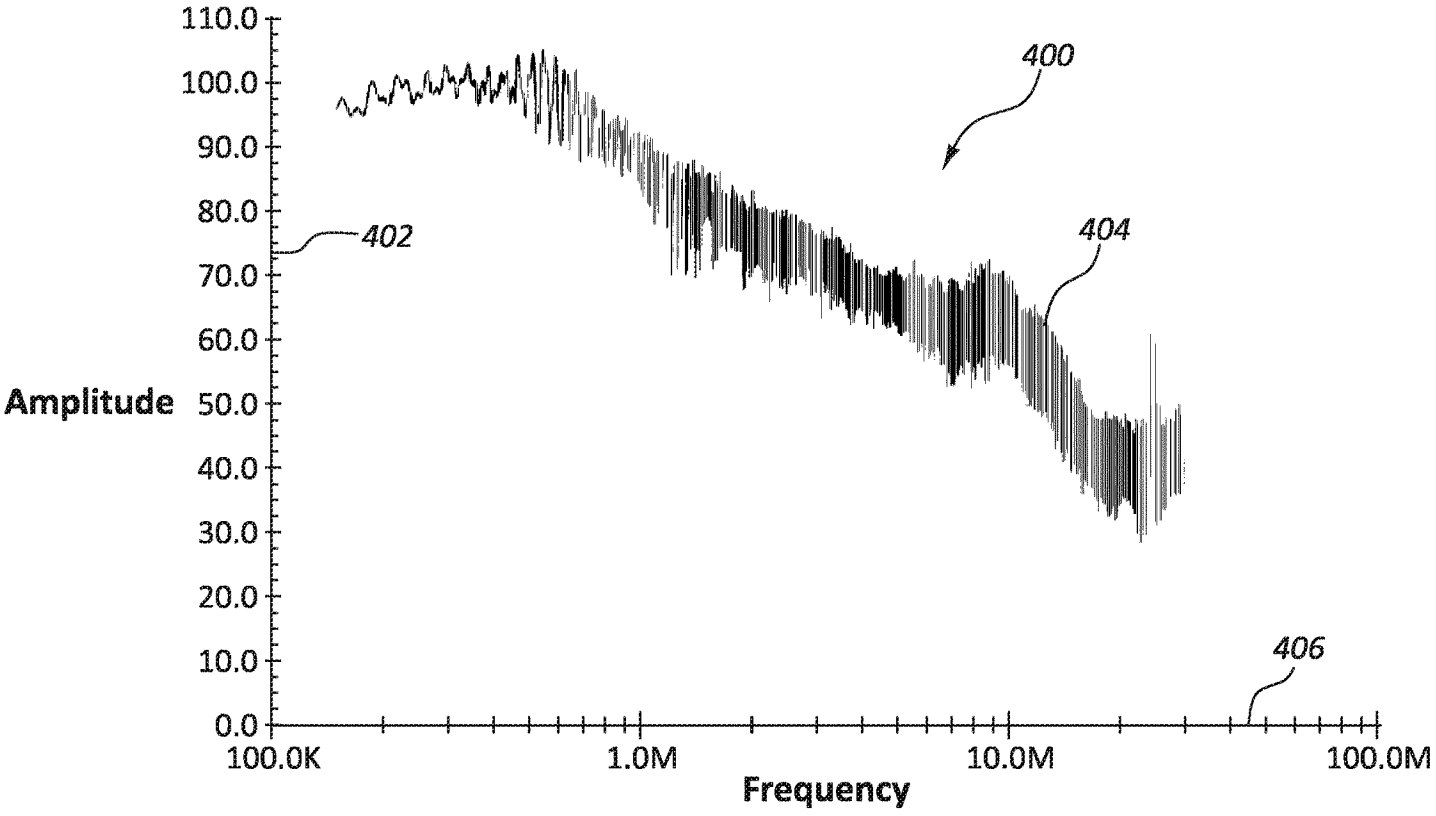
FIG. 4 illustrates a diagram of an example of characteristics of an electrical signal in accordance with the present disclosure.

FIG. 4 depicts a chart 400 of an example of waveform characteristics that may nuisance trip an arc fault detector when using a safe operational arcing device. In this chart 400, a y-axis 402 represents an amplitude of the waveform 404, and an x-axis 406 represents a frequency of the waveform.

In the example of FIG. 4, the waveform 404 depicts a relationship that frequencies within a 1.0 megahertz to 3.0 megahertz range have amplitudes between 82.0 decibels and 64.0 decibels. An arc fault detector may look at the amplitudes within this frequency range for arc fault detection. In this example, with the amplitudes being within an 82.0 decibel to 64.0 decibel range the arc fault detector may decide to cut power to the adapter 100.

Figure 5:
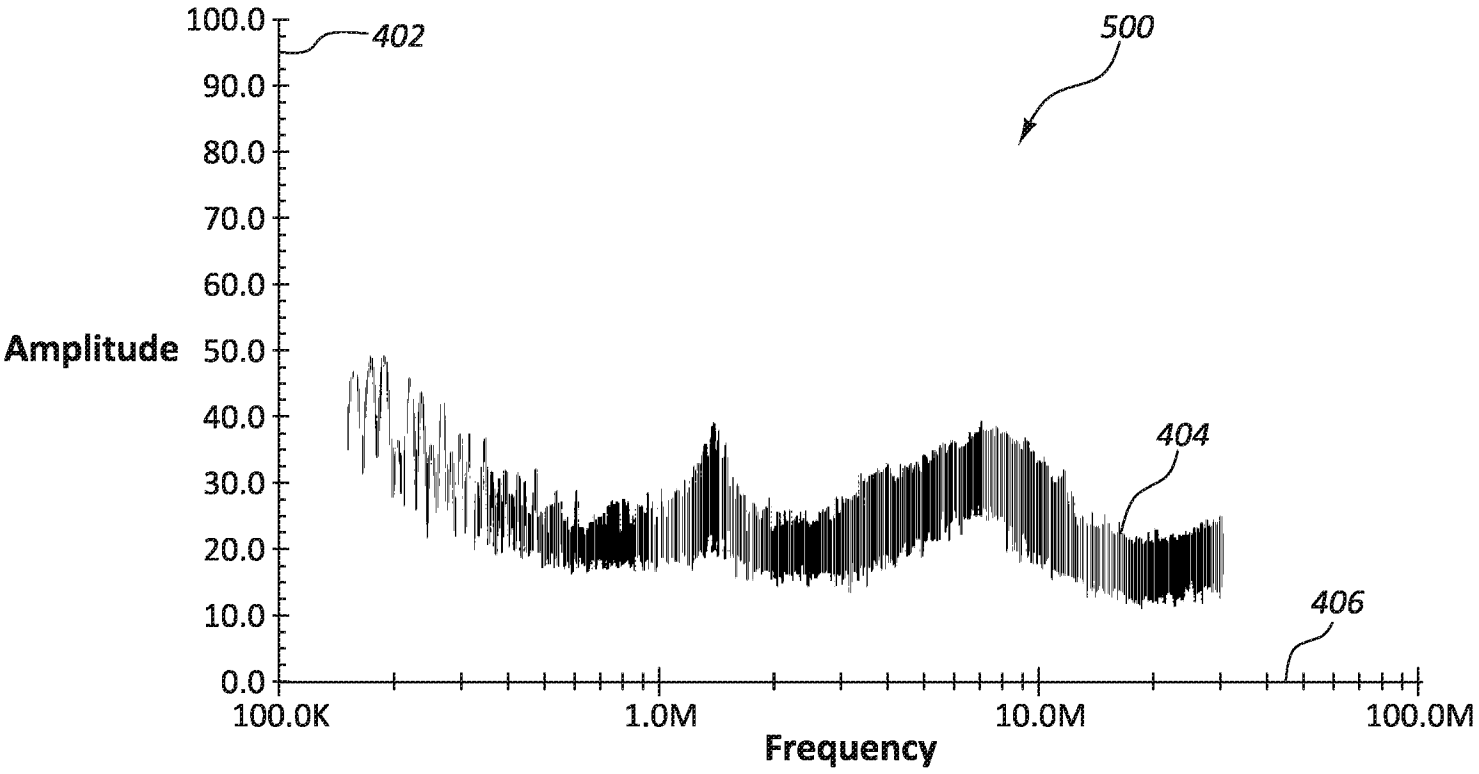
FIG. 5 illustrates a diagram of an example of characteristics of an electrical signal in accordance with the present disclosure.

FIG. 5 depicts a chart 500 of an example of waveform characteristics modified by the adapter 100 that may avoid nuisance tripping by an arc fault detector. In this chart 500, the y-axis 402 represents an amplitude of the modified waveform 404, and the x-axis 406 represents a frequency of the modified waveform 404.

In the example of FIG. 5, the modified waveform 404 depicts a relationship that frequencies within the 1.0 megahertz to 3.0 megahertz range have amplitudes below 50.0 decibels. Thus, in examples where an arc fault detector looks for amplitudes between 82.0 decibel and 64.0 decibels within a frequency range of 1.0 megahertz to 3.0 megahertz, the arc fault detector may decide to not trip the circuit and thereby continue to provide power to the operational arcing device plugged into the adapter 100.

While the examples of FIGS. 4 and 5 have been described with a specific waveform modification, any appropriate waveform modification may result from the filtering mechanism of the adapter in accordance to the present disclosure. For example, the amplitude may be lowered within a different frequency range, the amplitude may be increased within a specific frequency range, other characteristics of the waveform may be altered, or combinations thereof. In some examples, the arc fault detector analyzes the amplitudes of the waveform within a 2.0 megahertz to 5.0 megahertz frequency range.

Further, while the examples described above have been described with reference to specific signature waveform parameters that an arc fault detector may consider when deciding to trip the electrical circuit, any appropriate parameters may be considered by the arc fault detector in accordance with the present disclosure. For example, the arc fault detector may consider amplitude parameters, frequency parameters, intensity parameters, waveform shape parameters, other types of waveform parameters, or combinations thereof.

Figure 6:
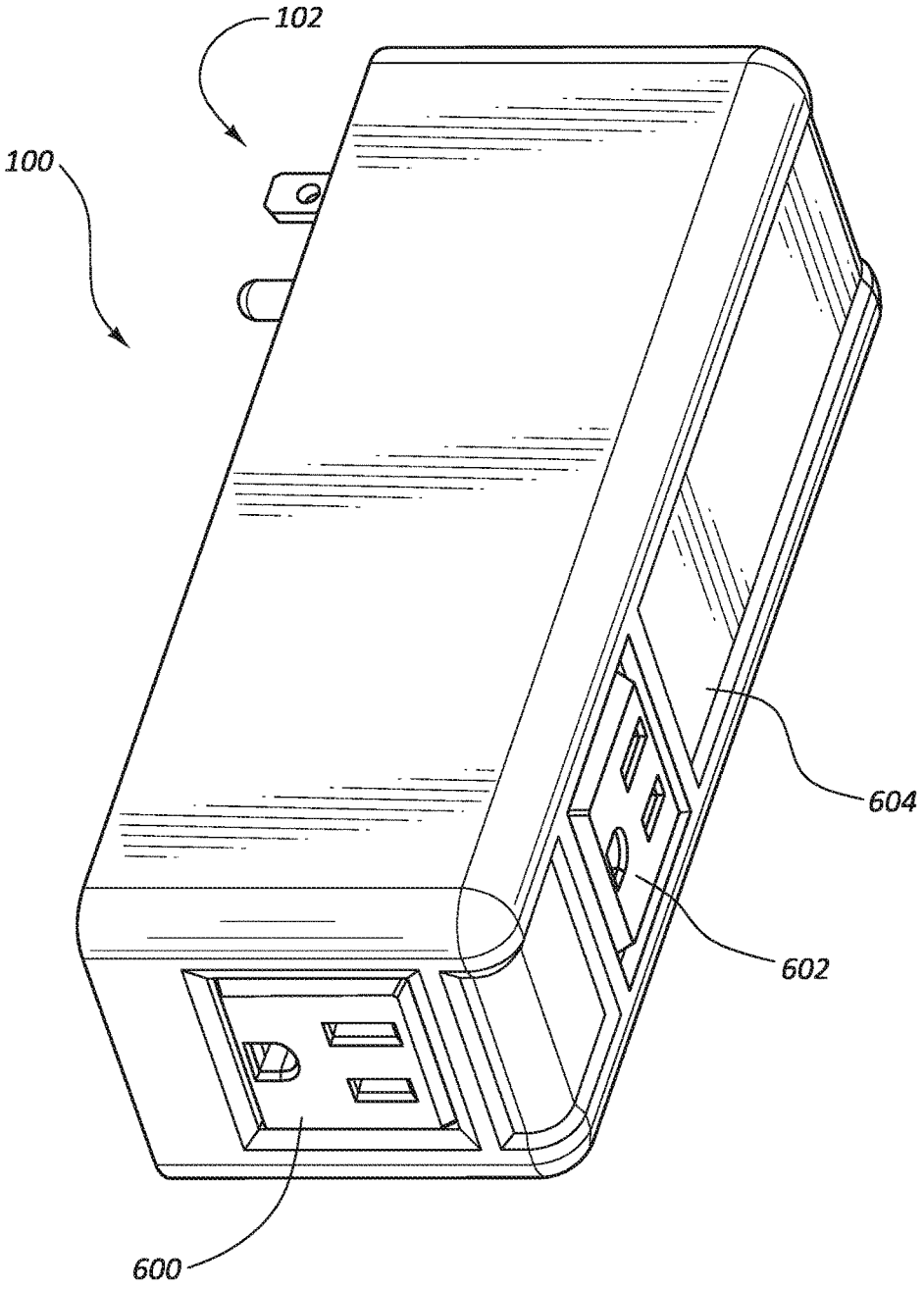
FIG. 6 illustrates a perspective view of an example of an adapter in accordance with the present disclosure.

FIG. 6 illustrates a perspective view of an example of an adapter 100 in accordance with the present disclosure. In this example, the adapter 100 has a first adapter socket 600 and a second adapter socket 602. Such an adapter 100 may allow multiple safe operational arcing devices to be plugged into the adapter 100 to receive power simultaneously. In the illustrated example, the second adapter socket 602 is oriented to be orthogonal to the first adapter socket 600. Such an arrangement may allow a user to more conveniently plug in different operational arcing devices at the same time.

Any appropriate number of adapter sockets may be incorporated into the adapter's body 604 or through a cord. For example, the adapter 100 may include at least three adapter sockets. Further, the adapter sockets may be positioned at any appropriate location on the adapter's body 604. In some embodiments, the first and second adapter sockets 600, 602 may be located on the same side of the adapter's body 604.

In some examples, the first and second adapter sockets 600, 602 may both be in communication with the same filtering mechanisms. In other examples, each of the first and second adapter sockets 600, 602 are in communication with different filtering mechanisms. Further, in other examples, just one of the first and second adapter sockets 600, 602 is in communication with a filtering mechanism.

While the examples above have been described with specific reference to the location of the adapter's plug 102, the adapter's plug 102 may be incorporated into the adapter 100 in any appropriate manner. For example, the plug 102 may be incorporated into the body 604 of the adapter 100 at any appropriate location. Further, in other examples, the plug 102 may be connected to the adapter's internal electrically conductive pathway 201 though a power cord extending from the adapter's body 604.

Figure 7:
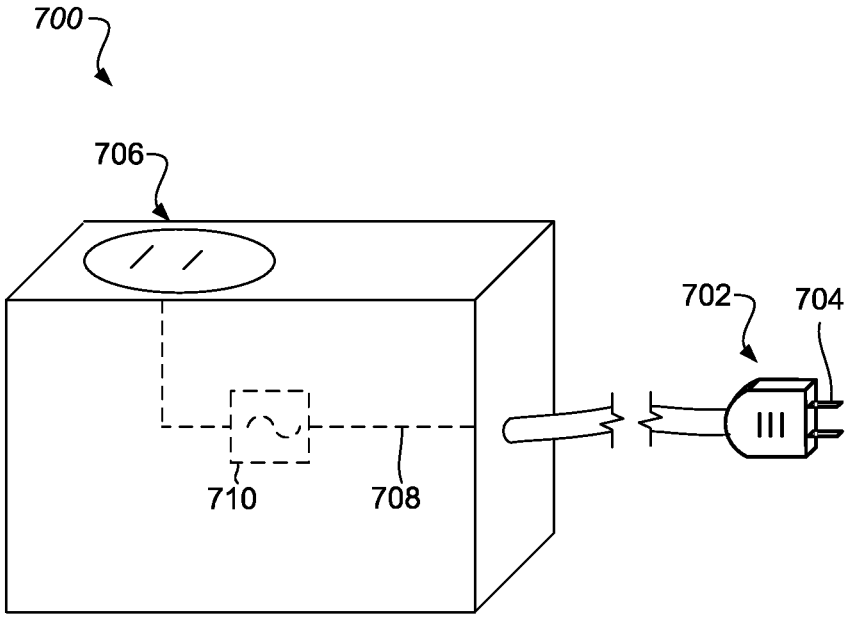
FIG. 7 illustrates a perspective view of an example of an adapter in accordance with the present disclosure.

FIG. 7 depicts an adapter 700 comprising a first plug 702 with at least one electrically conductive prong 704. A first socket 706 is shaped to make an electrical connection when a second plug is secured to the first socket 706. An electrically conductive pathway 708 that connects the first plug 702 with the first socket 706. A filtering mechanism 710 is disposed along the electrically conductive pathway 708 modifies an electrical waveform signature sufficient to avoid nuisance tripping by an arc fault detector when the electrically conductive pathway provides electrical power to an electrical load.

INDUSTRIAL APPLICABILITY

In general, the invention disclosed herein may provide an operational arcing device with electrical power through an adapter. In some circumstances, safe operational arcing devices may nuisance trip the arc fault detectors incorporated into some buildings. Such safe operational arcing devices may include common components, such as brush motors, switches, and other components commonly used in many safe commercially available products. When nuisance tripped, the operational arcing devices lose their electrical power, and the operational arcing devices may become inoperable. By using such operational arcing devices with an adapter described in the present disclosure, these operational arcing devices may avoid nuisance tripping.

The nuisance trip avoidance can occur due to the filtering mechanisms incorporated into the electrically conductive pathway between the adapter's electrical socket and the adapter's plug. Such a filtering mechanism may include inductive filters, capacitive filters, resistive filters, other types of filters, or combinations thereof. Such filters may obscure the electrical waveforms that are exhibited with the use of these operational arcing devices. The filtering mechanisms may modify at least one of those characteristics that are analyzed by the arc fault detector. Such modifications may prevent the arc fault detector from nuisance tripping.

In circumstances where a user is operating a safe operational arcing device that is plugged into an electrical socket incorporated into a wall of the building and the operational arcing device causes a nuisance trip, the user can unplug the operational arcing device from the electrical socket in the wall, plug in the adapter described herein into the wall's electrical socket, and plug the operational arcing device into the adapter. By doing so, the adapter changes the electrical waveform of the operational arcing device due to the adapter's filtering mechanisms and the operational arcing device can be used without nuisance tripping. Further, the user may plug in those operational arcing devices that are known to the user to have brush motors or are otherwise prone to nuisance tripping.

The filtering mechanism may attenuate the electrical waveform characteristics on the power line within desirable frequency ranges. For example, a high pass filter may attenuate signals with frequencies under a predetermined cut off frequency. Likewise, a low pass filter may attenuate signals with frequencies over a predetermined cut off frequency. In some examples, a filtering mechanism may be used to attenuate the signals within a predetermined frequency range, such as a range between 2.0 megahertz and 5.0 megahertz. As the signals attenuate, the amplitudes within the predetermined frequency ranges diminish Thus, in situations where the arc fault detector trips a circuit based on a relationship between amplitude and frequency, the adapter may prevent the arc fault detector from nuisance tripping.

Another advantage of the principles described in the present disclosure includes that the adapter can be used for more than one operational arcing device. For example, a user may have a treadmill and a blender that both use brush motors. Such operational arcing devices may be prone to nuisance tripping. The user may user the adapter when operating the treadmill and also for operating the blender. With the use of the adapter, the operational arcing devices do not have to be modified to avoid nuisance tripping. Further, a single operational arcing device can be used for multiple operational arcing devices.

Not all buildings include arc fault detection mechanisms. For example, National Electrical Code (NEC) started requiring arc fault detectors for certain rooms in 2002. Thus, many buildings built before the 2002 may not incorporate arc fault detectors. Even then, the NEC only required arc fault detection in certain rooms within a building. Thus, some of the rooms in a building may not include arc fault detectors while other rooms in the same building may include such arc fault detectors. Even for those buildings that include arc fault detection, not all of the arc fault detectors operate the same. For example, some of the arc fault detectors analyze different waveform characteristics. Some arc fault detectors may have been improved over the years, such that nuisance tripping is unlikely. With the inconsistent use of arc fault detectors, a user may operate an operational arcing device safely in one building, but be unable to use the operational arcing device in another building with arc fault detectors. The principles described in the present disclosure allow the user to continue to safely use his or her operational arcing device without having to replace the operational arcing device for use in those buildings.

The adapter may also include a surge protection mechanism. In some examples, the surge protection mechanism includes a varistor that can direct electrical current to ground when a high voltage is applied to the adapter. The varistor may exhibit a non-linear voltage current relationship that is exhibited by the resistance of the varistor changing quickly in the presence of a voltage spike. As the voltage spikes, the resistance of the varistor may drop to reroute the electrical current associated with the voltage spike to a safe location. Such rerouting may prevent a surge of electrical current from reaching the operational arcing device or from reaching other sensitive components.

The location of the adapter socket on the adapter's body may also be positioned at a location that is convenient for a user to plug in an operational arcing device while the adapter is plugged into the wall. In those circumstances where multiple electrical sockets are incorporated into the adapter's body, each of the electrical sockets may be positioned for the user's convenient use.

In some examples, the adapter includes a plug with a first prong and a second prong. Such an adapter may include an adapter socket that includes a first receptacle and a second receptacle for receiving plugs from other operational arcing devices such as appliances, blenders, treadmills, vacuums, other devices, and so forth. The adapter may also include an electrically conductive pathway internal to a housing of the adapter. The electrically conductive pathway includes at least one filtering mechanism.

The plug can be inserted into a building electrical socket that is in electrical communication with a power source. In some examples, the power source is an alternating current (AC) power source provided to the building from the power grid. Additionally, an operational arcing device can be plugged into the adapter socket. When the operational arcing device is plugged into the adapter, and an operational arcing device is plugged into the adapter, the operational arcing device can receive electrical power from the building's power source.

In some examples, the adapter's logic allows the filtering mechanism to switch into a filtering mechanism in appropriate circumstances. In such an example, the adapter can include an analyzer to determine if the waveform's characteristics are exhibiting accidental arcing signatures or other types of indicators that suggest that the power line will shortly exhibit the arcing signatures. The filtering mechanism may automatically activate in response to detecting such indicators. In such circumstances, the adapter can switch into a filtering mode before the arc fault detector identifies an arcing signature and shuts off power to the operational arcing device. In other examples, the adapter includes a manual switching mechanism that allows the user to manually instruct the adapter to use the filtering mechanism or not. Thus, the user can choose when the waveform is to be altered. For example, if the user knows that the device to be plugged into the adapter is a device that uses a brush motor or another type of operational arcing device, the user may manually switch the adapter into a filtering mode to prevent nuisance tripping. In other circumstances, the user may select a non-filtering mode because the user knows that he or she is using an device that does not use operational arcing. In such examples, any appropriate type of input mechanism may be incorporated into the adapter to allow the user to input into the adapter which type of mode (filtering or non-filtering) the user desires. Such input mechanisms may include levers, buttons, touch screens, mobile devices in communication with the adapter, dials, other types of input mechanism, or combinations thereof.

In some examples, a high-pass filter is used to modify the waveform characteristics of the electrical signal. Such a high-pass filter may allow portions of the signal with frequencies above a threshold frequency to pass unaltered. However, for portions of the signal that have a frequency below the threshold frequency, the characteristics of the waveform are altered. For example, for those frequencies below a specific threshold value, the amplitude of the waveform may be reduced by the filtering mechanism.

In other examples, a low-pass filter may be used to modify the characteristics of the waveform. In such an example, portions of a signal that have a frequency below a frequency threshold may pass through the filtering mechanism unaltered, but those portions of the signal that have a frequency higher than the frequency threshold may be modified. In such an example, those portions of the signal that have frequencies higher than the frequency threshold may experience an amplitude reduction.

Further, in other examples, the adapter uses a band-pass filter, which is a filter that passes frequencies within a certain frequency range and modifies the portions of the signal that are outside of that frequency range. For example, those portions of the signal that have frequencies outside of the frequency range may experience an amplitude reduction.

In yet another example, the adapter may use a band-stop filter, where just those frequencies within a predetermined frequency range are modified. In such an example, the portions of the signal with a frequency within the frequency range may also be subjected to reduced amplitudes. In one embodiment, a band-stop filter may be implemented according to the principles described herein to attenuate or reduce the amplitudes of those portions of the signal that are within a 150.0 kilohertz to 30.0 megahertz range, within a 1.0 megahertz to 6.0 megahertz range, within a 2.0 megahertz to 3.0 megahertz range, within another range, or combinations thereof.

Often, signatures that make evident arcing for certain types of operational arcing devices can fall within a frequency range of 2.0 megahertz to 5.0 megahertz. Thus, for adapters constructed for these types of operational arcing devices, the adapter may include a filtering mechanism that includes a band-stop filter for a frequency range of 2.0 to 5.0 megahertz. Thus, the filtering mechanism may cause the amplitudes within this frequency range to drop to avoid detection. However, even in such examples, the arc fault detector may conclude that higher amplitudes within broader frequencies ranges indicate the occurrence of accidental arcing. Thus, in such examples, the filtering mechanism may include a larger frequency range. In other examples, the filtering mechanism may include a low pass filter that allows all frequencies below 2.0 megahertz (a likely low end of the range where arcing signatures may occur in this example) to pass without alteration and for those frequencies above 2.0 megahertz to be altered with a lower amplitude. Similarly, the filtering mechanism may allow those frequencies above 5.0 megahertz (a likely high end of the range where arcing signatures may occur in this example) to pass unaltered while all the frequencies below are altered to have lower amplitudes.

While these examples have been described with reference to specific frequency ranges, specific frequency thresholds, and other specific filter characteristics, any appropriate type of frequency range and/or frequency threshold may be used in accordance with the principles described herein. For example, the frequency bands and/or frequency thresholds may be set to narrowly cover the frequency range where an arcing signatures is likely. In other examples, the frequency range and/or frequency thresholds may be set to cover a broader range of frequencies than just the most likely frequencies that exhibit arcing signatures.

In some examples, the filtering mechanism includes a first inductive filter, a first capacitive filter, a second inductive filter, and a second capacitive filter. In the illustrated example, the first and second inductive filters include a coil of wire incorporated into the electrically conductive pathway linking the adapter socket to the plug. However, any appropriate type of inductor may be used in accordance with the principles described in the present disclosure. Also, in the illustrated example, the first and second capacitive filters may include parallel plates that are incorporated into the electrically conductive pathway. However, any appropriate type of capacitor may be used in accordance with the principles described in the present disclosure.

While this example has been described with two inductive filters and two capacitive filters, any arrangement of filters may be used. For example, just a single capacitive filter and a single inductive filter may be used in the adapter. In alternative examples, just an inductive filter may be used or just a capacitive filter may be used. In yet other examples, more than two inductive filters may be used or more than just two capacitive filters may be used. In other examples, the filtering mechanism may include additional circuit elements that may contribute to filtering the waveform. For example, one or more resistors may be added to the electrically conductive pathway to alter the waveform's characteristics. In such an example, the resistor may be used in combination with just the capacitive filters, just the inductive filters, or combinations thereof. Such a resistor may be incorporated on the plug side of either the inductive filter or the capacitive filter. Similarly, the resistor may be incorporated on the adapter socket side of either the inductive filter or the capacitive filter.

The adapter socket may include electrical contacts to receive the prongs of a plug from the operational arcing device. The electrical contacts may be made of any appropriate type of electrically conductive material. In some examples, the electrical contacts are platted with an electrically conductive material. Any appropriate type of operational arcing device may be plugged into the adapter socket. In some examples, the operational arcing device has a brush motor that causes arcing under normal operating conditions. A non-exhaustive list of operational arcing devices that may be plugged into the adapter socket 108 include treadmills, elliptical exercise machines, washing machines, dryers, vacuums, blenders, pressure washers, air conditioners, devices with variable motor speeds, other types of devices, or combinations thereof. Such operational arcing devices may incorporate brush motors, switches, or other mechanisms that cause operational arcing during normal operation of these devices.

In certain examples, the adapter includes a plug with an alternating current (AC) neutral prong connected to an AC neutral line, an AC prong connected to an AC line, and a ground prong connected to a ground line. The AC neutral line and the AC line are electrically connected to the adapter socket. The first inductive filter, the first capacitive filter, the second inductive filter, and the second capacitive filter are disposed along the electrically conductive pathway connecting the plug and the adapter socket. Further, a first resistor and a second resistor connected in series is also disposed along the electrically conductive pathway and are in parallel with a varistor.

In some examples, the first and/or second inductive filter is a 4.0 micro-Henry inductor. However, any appropriate type of inductor may be used for the first and/or second inductive filters.

In some examples, the first and/or second capacitive filter is a 1.0 micro-Farad capacitor with a continuous AC maximum rating for 275 volts. However, any appropriate type of capacitor may be used for the first and/or second capacitor.

In some examples, the first and/or second resistor is a 1.0 mega-Ohm resistor. However, any appropriate type of resistor may be used for the first and/or second resistor.

A surge protection mechanism may be incorporated into the adapter. In some cases, the surge protection mechanism includes a voltage dependent varistor that is connected to the AC neutral line and the AC line. The varistor can change its level of resistance based on the amount voltage to which the varistor is subjected. Generally, under normal operating conditions, where the varistor is subjected to voltages within an expected range, the varistor's resistance is high. In such a high resistance state, the varistor allows little, if any, electrical current to pass. Current still flows through the adapter through the AC line and AC neutral line, but bypasses the varistor. However, when exposed to higher than expected voltages, the varistor's resistance automatically lowers, which allows more current to flow through the varistor. The resistance of the varistor with a lower resistance may create a more preferential electrical pathway to ground. As a result, current flow is diverted from the AC line and AC neutral line to ground through the low resistance varistor. Such rerouting prevents a current surge away from the operational arcing devices plugged into the adapter thereby sparing the operational arcing device from the increased amount of current flow. For example, if a high voltage is applied to the varistor, the varistor may exhibit a low resistance and thereby cause the electrical current to bypass the components of the adapter's circuitry and those devices plugged into the adapter. Such current spikes may be diverted to the ground line. On the other hand, the varistor may exhibit a higher resistance in situations where the varistor is subjected to a lower voltage within the expected voltage range. In such expected voltage ranges, the varistor's high resistance prevents the varistor from forming a short path to ground, which causes the electrical current to flow through the other components of the adapter and to the operational arcing devices.

In one example, the varistor may be a metal oxide varistor. A metal-oxide varistor may exhibit the non-linear current-voltage characteristics as described above. Such varistors can be used to protect the adapter against excessive transient voltages, such as lighting strikes or other events that impose voltage spikes on adapter. By incorporating such metal oxide varistors into the adapter's circuit, the metal oxide varistor can shunt the current created by the high voltage away from sensitive components.

In some examples, the metal-oxide varistor contains a ceramic material. Such a ceramic material may include zinc oxide, bismuth oxide, cobalt oxide, manganese oxide, other types of metal oxides, or combinations thereof. The ceramic material may be positioned between two electrodes. The molecular characteristics of the grains of the metal oxides form boundaries which cause the current to flow in only one direction. Thus, such a ceramic material forms multiple diode junctions throughout its volume. When a small or moderate voltage is applied across the electrodes, only a tiny current flows, caused by reverse leakage through the diode junctions. When a large voltage is applied, the diode junction breaks down due to thermionic emission and electron tunneling. The break down in the junction pairs results in a large current flow through the ceramic material.

While this example of a surge protection mechanism has been described with reference to a metal oxide varistor, any appropriate type of voltage-dependent resistance mechanism may be used in accordance with the principles described in the present disclosure for surge protection. For example, voltage suppression diodes, Zener diodes, other types of varistors, gas discharge tubes, transient voltage suppressors, avalanche diodes, other types of surge protection mechanisms, or combinations thereof may be used in accordance with the principles described in the present disclosure.

Additionally, a third capacitor may electrically connect the AC line to the ground line, and a fourth capacitor may electrically connect the AC neutral line to the ground line. In some examples, the third and fourth capacitors may be 10000.0 pico-Farad capacitors with a continuous maximum AC voltage limit of 250 volts.

While the illustrated example puts forth a single electrical circuit for an adapter with a filtering mechanism, any appropriate type of circuitry may be used for an adapter that includes a filtering mechanism capable of modifying the electrical signal's waveform to avoid arc fault detection based nuisance tripping. For example, filtering elements, such as inductors, resistors, capacitors, and so forth, may be arranged in parallel, in series, in different spatial order with respect to other circuit components, or combinations thereof.

What is claimed is:

1. An adapter, comprising:

a first plug with at least one electrically conductive prong;

a first socket shaped to make an electrical connection when a second plug is secured to the first socket;

an electrically conductive pathway that connects the first plug with the first socket;

a filtering mechanism disposed along the electrically conductive pathway and comprising a band-stop filter that modifies an electrical waveform signature received from an operational arcing device in a frequency range of the operational arcing device sufficient to avoid nuisance tripping of an arc fault detector by the operational arcing device when the electrically conductive pathway provides electrical power to the operational arcing device; and an analyzer to determine that the electrical waveform signature is exhibiting an arcing signature; and logic to automatically activate the filtering mechanism before the arc fault detector shuts off power to the operational arcing device based at least in part on determining that the electrical waveform signature is exhibiting the arcing signature.

2. The adapter of claim 1, wherein the filtering mechanism comprises at least one inductive filter.

3. The adapter of claim 1, wherein the filtering mechanism comprises at least one capacitive filter.

4. The adapter of claim 1, wherein the filtering mechanism comprises a first inductive filter, a first capacitive filter, a second inductive filter, and a second capacitive filter.

5. The adapter of claim 1, wherein the filtering mechanism reduces an amplitude of the electrical waveform signature.

6. The adapter of claim 5, wherein the filtering mechanism reduces the amplitude of the electrical waveform signature within the frequency range of 150.0 kilohertz to 30.0 megahertz.

7. The adapter of claim 6, wherein the frequency range is 1.0 megahertz to 6.0 megahertz.

8. The adapter of claim 6, wherein the filtering mechanism reduces the amplitude of the electrical waveform signature to below 60.0 decibels within the frequency range.

9. The adapter of claim 6, wherein the filtering mechanism reduces the amplitude of the electrical waveform signature to below 50.0 decibels within the frequency range.

10. The adapter of claim 1, further comprising a second socket in electrical communication with the first plug through the electrically conductive pathway.

11. The adapter of claim 10, wherein the second socket is positioned in an orthogonal orientation to the first socket.

12. The adapter of claim 1, wherein the electrically conductive pathway includes a surge protection mechanism.

13. An adapter, comprising:

a first plug with at least one electrically conductive prong;

a first socket shaped to make an electrical connection when a second plug is secured to the first socket;

an electrically conductive pathway that connects the first plug with the first socket;

a filtering mechanism disposed along the electrically conductive pathway that modifies an electrical waveform signature received from an operational arcing device sufficient to avoid nuisance tripping of an arc fault detector by the operational arcing device when the electrically conductive pathway provides electrical power to the operational arcing device;

an analyzer to determine that the electrical waveform signature is exhibiting an arcing signature; and logic to automatically activate the filtering mechanism before the arc fault detector shuts off power to the operational arcing device based at least in part on determining that the electrical waveform signature is exhibiting the arcing signature.

14. The adapter of claim 13, wherein the filtering mechanism comprises at least one inductive filter.

15. The adapter of claim 13, wherein the filtering mechanism comprises at least one capacitive filter.

16. The adapter of claim 15, wherein the filtering mechanism reduces the amplitude of the electrical waveform signature to below 50.0 decibels within the frequency range.

17. The adapter of claim 15, further comprising a second socket in electrical communication with the first plug through the electrically conductive pathway.

18. The adapter of claim 17, wherein the second socket is positioned in an orthogonal orientation to the first socket.

19. The adapter of claim 15, wherein the electrically conductive pathway includes a surge protection mechanism.

20. An adapter, comprising:

a first plug with at least one electrically conductive prong;

a first socket shaped to make an electrical connection when a second plug is secured to the first socket;

an electrically conductive pathway that connects the first plug with the first socket;

a filtering mechanism disposed along the electrically conductive pathway and comprising a band-stop filter that modifies an electrical waveform signature received from an operational arcing device in a frequency range of the operational arcing device sufficient to avoid nuisance tripping of an arc fault detector by the operational arcing device when the electrically conductive pathway provides electrical power to the operational arcing device;

an analyzer to determine that the electrical waveform signature is exhibiting an arcing signature; and logic to automatically activate the filtering mechanism before the arc fault detector shuts off power to the operational arcing device based at least in part on determining that the electrical waveform signature is exhibiting the arcing signature.

* * * * *